US008491069B2

(12) United States Patent
Haemmerle

(10) Patent No.: US 8,491,069 B2
(45) Date of Patent: Jul. 23, 2013

(54) LOCKABLE PULL-OUT GUIDE

(75) Inventor: Hermann Haemmerle, Lustenau (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 13/561,351

(22) Filed: Jul. 30, 2012

(65) Prior Publication Data

US 2012/0326586 A1 Dec. 27, 2012

Related U.S. Application Data

(63) Continuation of application No. PCT/AT2011/000060, filed on Feb. 3, 2011.

(30) Foreign Application Priority Data

Feb. 3, 2010 (AT) ..... A 143/2010

(51) Int. Cl.
*A47B 88/00* (2006.01)

(52) U.S. Cl.
USPC ..... 312/333; 312/334.6

(58) Field of Classification Search
USPC ..... 312/333, 334.6, 348.4, 348.2, 334.44, 312/334.46, 334.47; 384/21, 22
See application file for complete search history.

(56) References Cited

U.S. PATENT DOCUMENTS 1,906,723 A * 5/1933 Rosendahl ..... 312/270.3
2,510,807 A * 6/1950 Fosberg ..... 312/273
3,782,800 A * 1/1974 Remington et al. ..... 312/333
4,274,689 A 6/1981 Vander Ley et al.
4,557,531 A * 12/1985 Rock et al. ..... 384/18
5,580,139 A * 12/1996 Grabher ..... 312/333
5,632,541 A * 5/1997 Uthoff ..... 312/333
6,036,291 A * 3/2000 Rock ..... 312/333
2002/0089272 A1 7/2002 Liang et al.

(Continued)

FOREIGN PATENT DOCUMENTS

AT 384 535 11/1987
DE 33 26 400 1/1985

(Continued)

OTHER PUBLICATIONS

International Search Report issued Jun. 30, 2011 in International (PCT) Application No. PCT/AT2011/000060.

(Continued)

*Primary Examiner* — Janet M Wilkens
(74) *Attorney, Agent, or Firm* — Wenderoth, Lind & Ponack, L.L.P.

(57) ABSTRACT

An arrangement includes a drawer and a pull-out guide for the drawer. The drawer has a drawer container and a front panel that can be connected to the drawer container, and the pull-out guide has at least one body rail for fastening to a furniture body and at least one drawer rail, which can be moved relative to the body rail between an open position and a closed position and on which the drawer can be fastened to the pull-out guide. The arrangement also includes a releasable locking element so that, in a locking position, the motion of the drawer rail in the closing direction relative to the body rail can be stopped in an intermediate position before the closed position is reached, and, in a release position, the motion of the drawer rail in the closing direction relative to the body rail can be released until the closed position is reached.

11 Claims, 16 Drawing Sheets

U.S. PATENT DOCUMENTS

| | | | | |
|---|---|---|---|---|
| 2004/0000852 | A1* | 1/2004 | Lam Harn et al. | 312/348.4 |
| 2010/0314981 | A1* | 12/2010 | Koenig et al. | 312/333 |
| 2010/0320888 | A1* | 12/2010 | Koenig et al. | 312/333 |
| 2010/0327719 | A1* | 12/2010 | Koenig et al. | 312/333 |
| 2012/0306337 | A1* | 12/2012 | Hammerle | 312/334.8 |

FOREIGN PATENT DOCUMENTS

| | | | |
|---|---|---|---|
| DE | 40 05 405 | | 10/1990 |
| DE | 4124512 | * | 2/1992 |
| DE | 201 06 080 | | 6/2001 |
| JP | 406339414 | * | 12/1994 |
| WO | 2009114887 | * | 9/2009 |

OTHER PUBLICATIONS

Austrian Patent Office Search Report completed Nov. 4, 2010 in Austrian Patent Application No. A 143/2010.

* cited by examiner

LOCKABLE PULL-OUT GUIDE

This application is a Continuation of International Application No. PCT/AT2011/000060, filed Feb. 3, 2011, the entire disclosure of which is incorporated herein by reference.

BACKGROUND OF THE INVENTION

The invention concerns an arrangement comprising a drawer and an extension guide for the drawer, wherein the drawer has a drawer container and a front panel which can be connected to the drawer container and wherein the extension guide has at least one carcass rail for fixing to a furniture carcass and at least one drawer rail which is moveable relative to the carcass rail between an open position and a closed position and to which the drawer can be fixed with the extension guide. A releasable locking element is provided by which, in a locking position, the movement of the drawer rail in the closing direction relative to the carcass rail can be stopped in an intermediate position before reaching the closed position and, in a release position, the movement of the drawer rail in the closing direction relative to the carcass rail is enabled until reaching the closed position. The invention also concerns an article of furniture having a furniture carcass and such an arrangement.

In the case of extension guides, the drawer rail and the carcass rail in the non-mounted condition are movable relative to each other from a completely open position to a completely closed position. The same applies if such an extension guide is mounted at both sides by way of a carcass rail in a furniture carcass. Fitting or fixing a drawer on the extension guide is possible in the mounted condition of the extension guide, even if the drawer rail is in the closed position relative to the carcass rail—and is thus entirely inward. When inserting the drawer into the extension guide, poor accessibility to the drawer rail which is disposed entirely rearwardly or inwardly can lead to problems. Even worse are the problems if the drawer is already inserted and a front panel of a front pull-out arrangement is to be mounted to the drawer container as the front panel butts against the furniture carcass before it in any way moves into a position sufficiently close to the drawer container.

Such an arrangement is also already known from AT 384 535 B, in which a locking element in the form of a pawl inhibits the movement of the rails relative to each other. In that patent it will be noted that the locking element serves only for making it easier to fit the drawer to the extension guide as the drawer rail cannot reciprocate unimpededly between the open and closed positions.

In addition DE 33 26 400 A1 shows a drawer mounted on telescopic rails, wherein the movement between the telescopic rails is checked by a lock. In this specification also that lock can only be released by hand. There is not a functional connection in respect of releasing the lock with the fitment of a drawer. The lock serves in particular to lock the inserts mounted on the telescopic rails in a given position, in particular when the telescopic rails are fully pulled out.

U.S. Pat. No. 4,274,689 discloses a locking element for checking the movement between rails of an extension guide. That locking element serves in particular to provide that the drawer cannot be simply removed in the completely open position as the stop element butts in a recess in the carcass rail. It is only by manual actuation of the member that the arresting position can be released and then the drawer together with the drawer rail can be lifted away from the carcass rail.

Therefore the object of the invention is to facilitate fitment of the drawer to the extension guide or fitment of the front panel to the drawer container. In particular, the invention seeks to provide that, in the mounted condition of the extension guide, the drawer rail can be easily reached so that fitment of the drawer or fitment of the front panels to the drawer container is possible without any problem.

SUMMARY OF THE INVENTION

The above object is attained in conjunction with a classifying portion feature by a release element, wherein the locking element can be automatically unlocked by the release element either when the drawer is fixed to the drawer rail or when the front panel is mounted to the drawer container which is already fixed to the drawer rail. In that way, it is only when the drawer is fitted to the drawer rail or when the front panel is fitted to the container that automatic unlocking of the movement check as between the drawer rail and carcass rail is effected.

In principle—to explain the mutually alternative features of the present invention—two variants are involved on assembling drawers and when mounting a drawer to an extension guide.

A first variant accordingly provides that a complete four-sided drawer (rear wall, two side walls and front panel) is already fixedly and finally assembled, and that assembled drawer is then fitted on the drawer rail. With that fitment operation, the check on movement between the drawer rail and the carcass rail is then suitably released so that the drawer rail can move into the completely closed position.

It will be noted, however, in accordance with a second variant that it that the drawer is not connected in one piece to the extension guide. Rather an initially three-sided drawer (rear wall and two side walls) can be fixed to the "forward looking" drawer rail, in which case the movement check as between the drawer rail and the carcass rail is not yet unlocked. It is only with fitment of the front panel to the rest of the drawer, that is already fixed to the drawer rail, that unlocking of the locking element is effected by the release element, and the drawer can be moved into the closed position.

Prior to unlocking, the drawer rail cannot reciprocate unimpededly between the open and closed position on the carcass rail and is prevented from enjoying complete freedom of movement and is stopped at a given location. That means that, when inserting the drawer container or when fitting the front panel, the drawer rail cannot be moved completely rearwardly as far as the abutment, but rather is stopped further forwardly in an intermediate position in which attainable access is enjoyed and thus the drawer or the front panel respectively can be fixed in position without any problem.

When the extension guides are mounted to a furniture carcass, it is often not yet possible to foresee what kinds of drawers are fitted. Particularly when it is not yet known what kind of front panel the drawer has, the maximum closed position of the drawer rail relative to the carcass rail, that is possible during use, is not yet known. If more specifically the front panel is in the form of a front pull-out arrangement, the drawer rail in the operative condition cannot in any way pass into the absolutely closed position as the front panel of the front pull-out arrangement already previously butts against the furniture carcass. If, however, the front panel is intended for an internal pull-out arrangement, the drawer rail can pass completely into the closed position relative to the carcass rail. If now when fitting the front panel to the drawer container the drawer rail is completely in the closed position with the carcass rail, the front panel cannot be in any way fitted to the drawer or to the drawer rail as it is already too far in the furniture carcass. For that reason, in a preferred embodiment of the invention, it is provided that the closed position of the drawer rail corresponds to a completely closed drawer and that position of the drawer rail, in which it is lockable with respect to the carcass rail by way of the locking element is just before, preferably between 1 mm and 20 mm before, the closed position.

In a further preferred embodiment a release element can be arranged on the drawer.

As already stated, the drawer can have a drawer container and a front panel which can be connected to the drawer container by way of a connecting element. In accordance with a quite particularly preferred embodiment, the release element can be arranged on the front panel or the connecting element. In that way, it is only when mounting the front panel to the drawer container that is already fixed to the drawer rail, that the locking action is released, and it is only then that the drawer rail can move from the previously locked intermediate position into the closed position. In that way, fitment of the front panel is always possible independently of the type of front panel, on the extension guide which is already fitted in place in the furniture carcass. It is only by virtue of the fitting procedure that the locking action is released.

It can further preferably be provided that the locking element is arranged—movably between a locked position and a released position—on the extension guide, preferably on its drawer rail and has an abutment extension. As a result, the locking element butts in the locked position against a limiting extension of the extension guide, preferably on the carcass rail, and stops the closing movement of the drawer rail relative to the carcass rail. It should not be out of the question that this limiting extension can also be provided on the furniture carcass itself or the locking element acts, for example, between the drawer container and the carcass rail. In that respect, it could be provided for example that the drawer container mounted to the drawer rail without a front panel can never in any way pass into the completely closed position due to the locking element. It is only after fitment of the front panel that that locking action could be removed.

In general, there are two alternative embodiments of the present invention, whereby either the release element butts against the locking element when fixing the drawer to the drawer rail and moves same from the locked position into the released position, or the release element butts against the locking element when connecting the front panel to the drawer container by way of the connecting element and moves same from the locked position into the released position. In any event, the second variant is preferred.

In a further preferred variant, the locking element is mounted pivotably to the drawer rail and has a spring acting on the drawer rail, preferably a leg spring. Upon unlocking, the release element pivots the locking element together with its abutment extension into the released position against the spring force of the spring.

If the locking element together with abutment extension and spring is in the form of a plastic part which is injection-molded in one piece, manufacture is particularly simple and also fitment to the extension guide can be effected in a relatively uncomplicated procedure.

BRIEF DESCRIPTION OF THE DRAWINGS

Further details and advantages of the present invention are described by means of the specific description with reference to the embodiments by way of example illustrated in the drawings, in which.

DETAILED DESCRIPTION OF THE INVENTION

Figure 1:
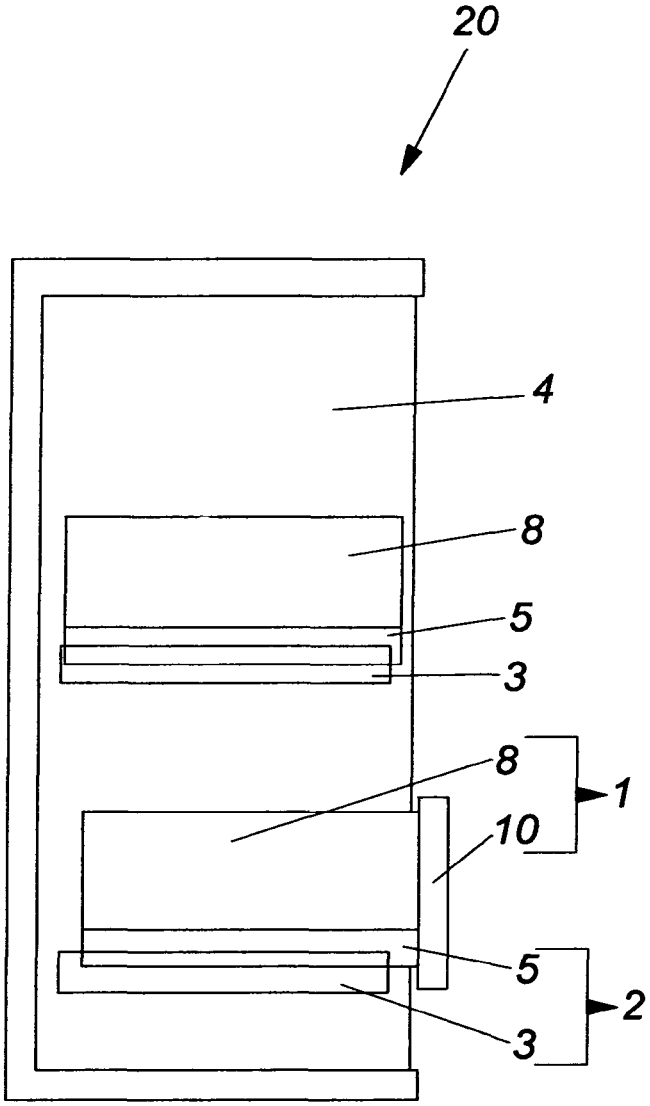
FIG. 1 shows a diagrammatic view of an article of furniture together with extension guides and drawer, FIG. 1*a* diagrammatically shows an internal pull-out arrangement from above, FIG. 1*b* diagrammatically shows a front pull-out arrangement from above.
Figure 1A:
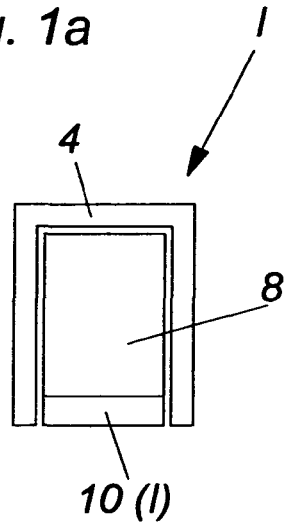
Figure 1B:
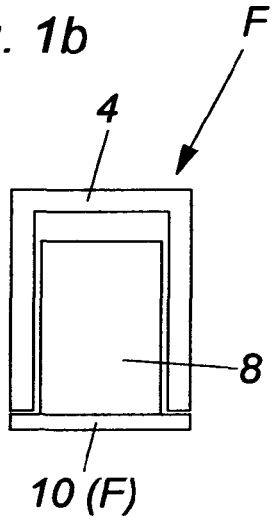

FIG. 1 shows an article of furniture 20, an extension guide 2 being mounted to the furniture carcass 4 in the upper region. Of that extension guide 2, the carcass rail 3 is mounted to the furniture carcass 4. The drawer rail 5 is displaceably mounted on the carcass rail 3, the extension guide 2 being shown here in the closed position SS. It can already be seen that fitment of a front panel 10 to a drawer container 8 fixed to the drawer rail 5 is no longer possible as they are moved too far into the furniture carcass and the distance between the front panel 10 and the drawer container 8 is too large. That can be seen, in particular, also from FIG. 1*a* showing an internal pull-out arrangement I. In that case, the drawer container 8 and therewith the drawer rail 5 are already in the completely closed position SS in the furniture carcass 4. Fitment of a front panel 10 for a front pull-out arrangement F would no longer be possible in that position SS because the front panel 10 (as in FIG. 1*b*) already butts against the furniture carcass 4 before reaching the closed position SS.

Figure 2:
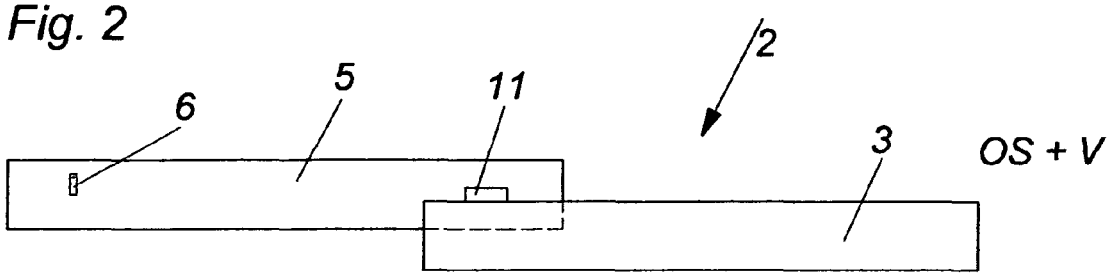
FIGS. 2 through 5 show the procedure when fitting a drawer to the extension guide.

In that respect, FIG. 2 shows how the parts of the extension guide 2 are disposed in relation to each other in the open position OS. The locking element 6 is arranged on the drawer rail 5. The limiting extension 11 is disposed on the carcass rail 3. The locking element 6 is shown in the locking position V.

Figure 3:
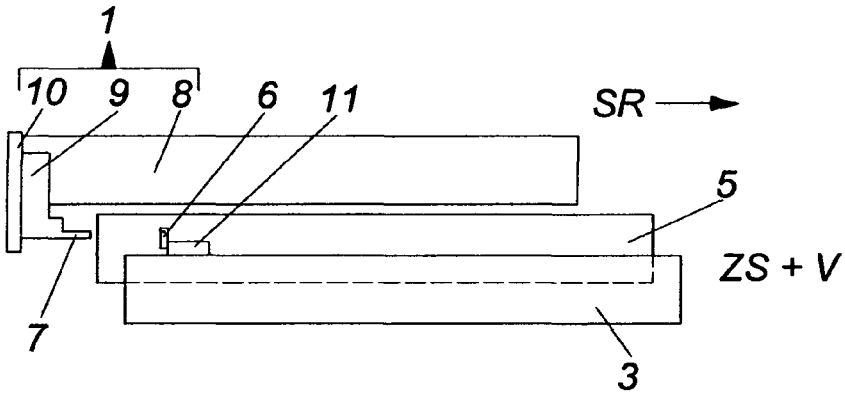

FIG. 3 shows the drawer rail 5 in the intermediate position ZS relative to the carcass rail 3, wherein the locking element 6 butts against the limiting extension 11 and allows no further movement in the closing direction SR. In that intermediate position ZS, a drawer 1 comprising a drawer insert 8, a front panel 10 and a connecting element 9 disposed therebetween can be fixed to the drawer rail 5 without any problem independently of the front panel type F or I.

Figure 4:
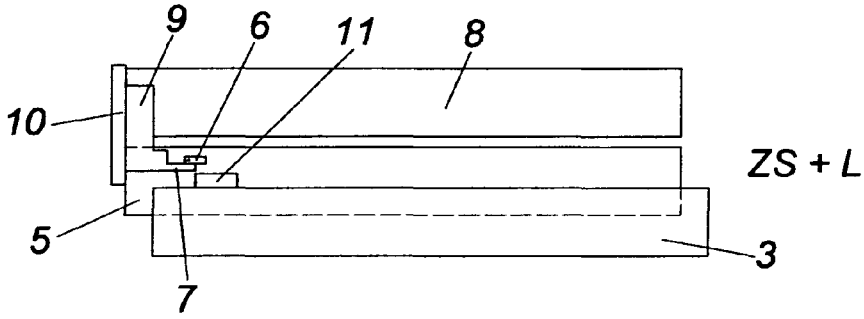
Figure 5:
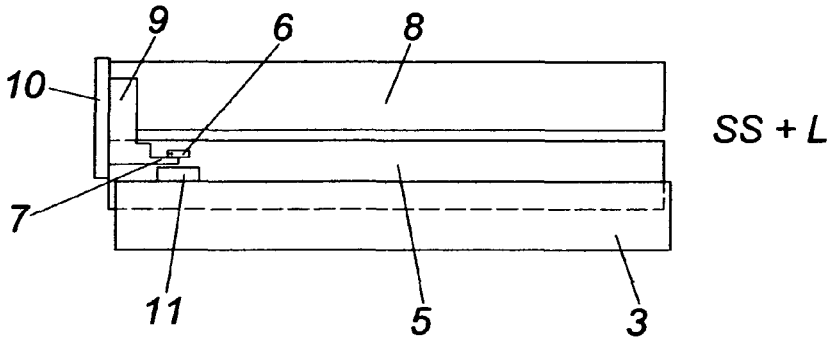

When then, as shown in FIG. 4, the drawer 1 has been fixed to the drawer rail 5 and the release element 7 of the connecting element 9 has moved the locking element 6 into the release position L, the complete movement in the closing direction SR until the closed position SS is reached can be continued (FIG. 5). Locking of the drawer 1 to the extension guide 2 can be effected by known latching or fixing devices.

Figure 6:
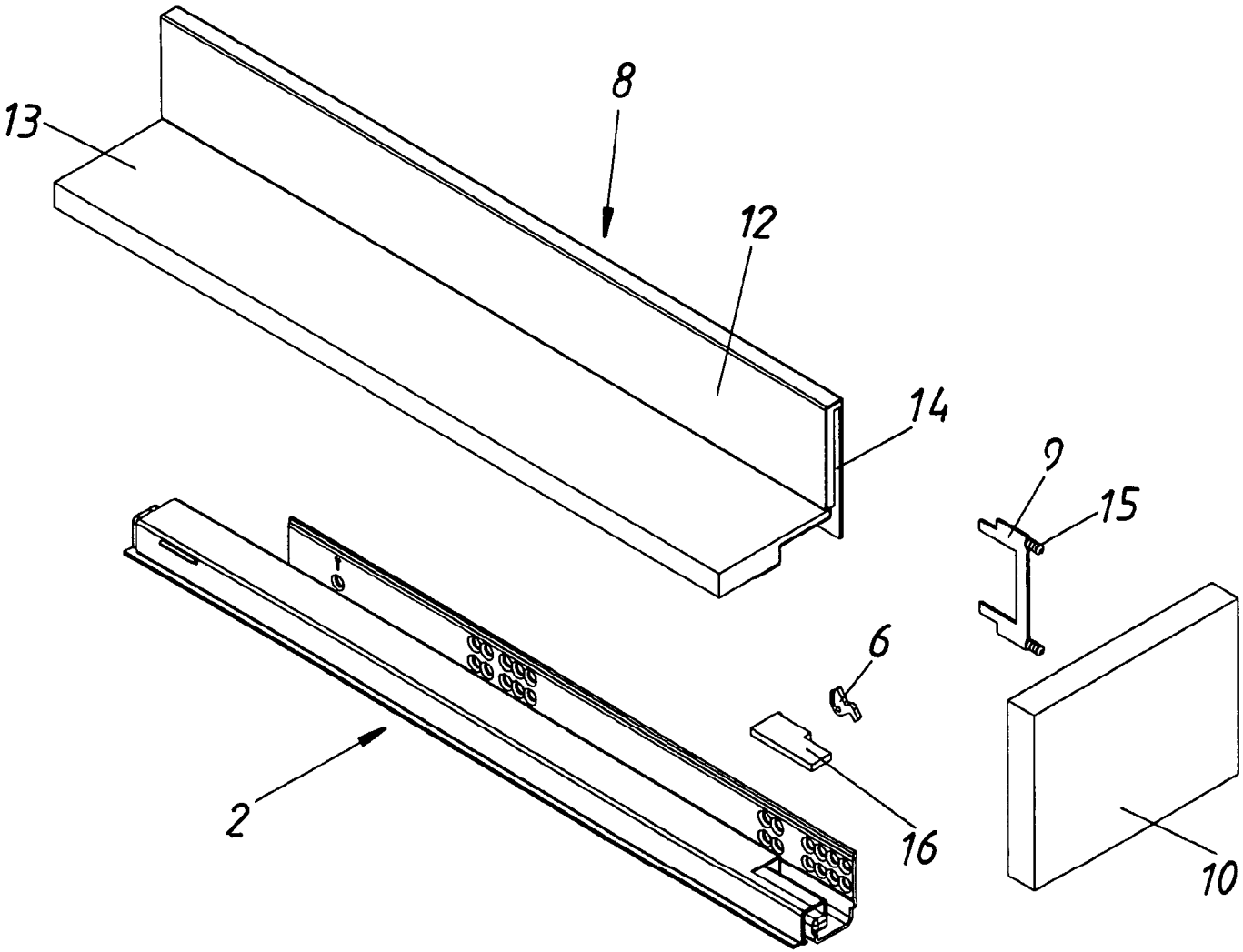
FIG. 6 shows an exploded view of parts of the drawer and the extension guide.

FIG. 6 shows a portion of the drawer container 8 which substantially comprises a drawer frame structure 12 and a drawer bottom 13 comprising, for example, wood. Provided in the end region of the side wall of the drawer frame structure 12 is a receiving opening 14 in which the front panel 10 can be fixed by way of the connecting element 9. The connecting element 9 is fixed in the front panel 10 by way of fixing extensions 15 (for example pegs). In addition, FIG. 6 shows an extension guide 2 to which the locking element 6 can be mounted, for example, by way of a mounting insert 16.

Figure 7:
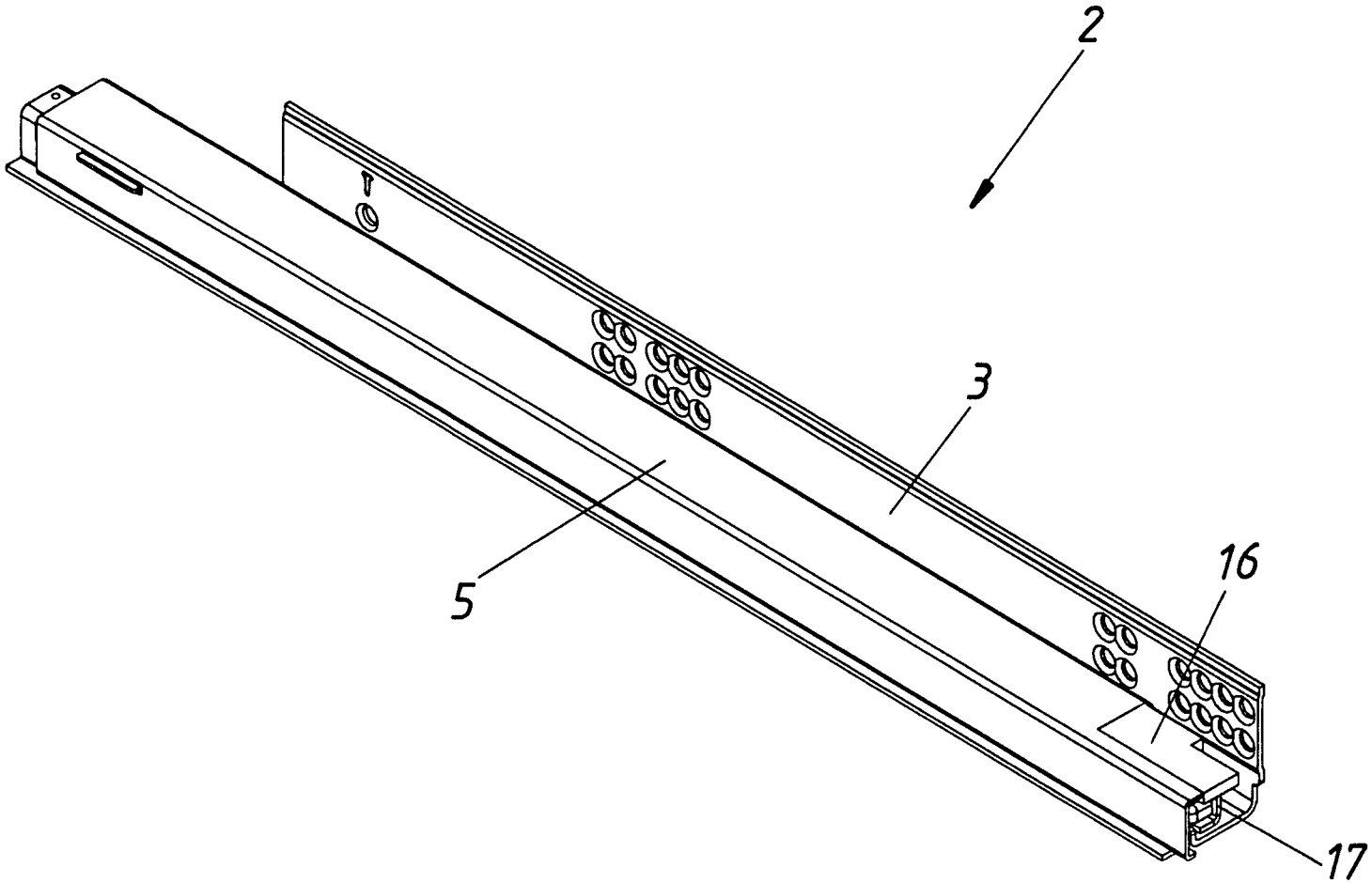
FIG. 7 shows an extension guide.

FIG. 7 shows the assembled extension guide 2 comprising a drawer rail 5, a carcass rail 3 and the mounting insert 16 fitted to the drawer rail 5. Depending on the respective design of the extension guide 2, there can also be a third rail (central rail 17).

The position of the drawer rail 5 relative to the carcass rail 3 is diagrammatically shown in each case at the top in FIGS. 8, 9, 10 and 12, with the closing direction SR pointing towards the left whereas the closing direction SR is towards the right in the respective lower views of the locking region.

Figure 8:
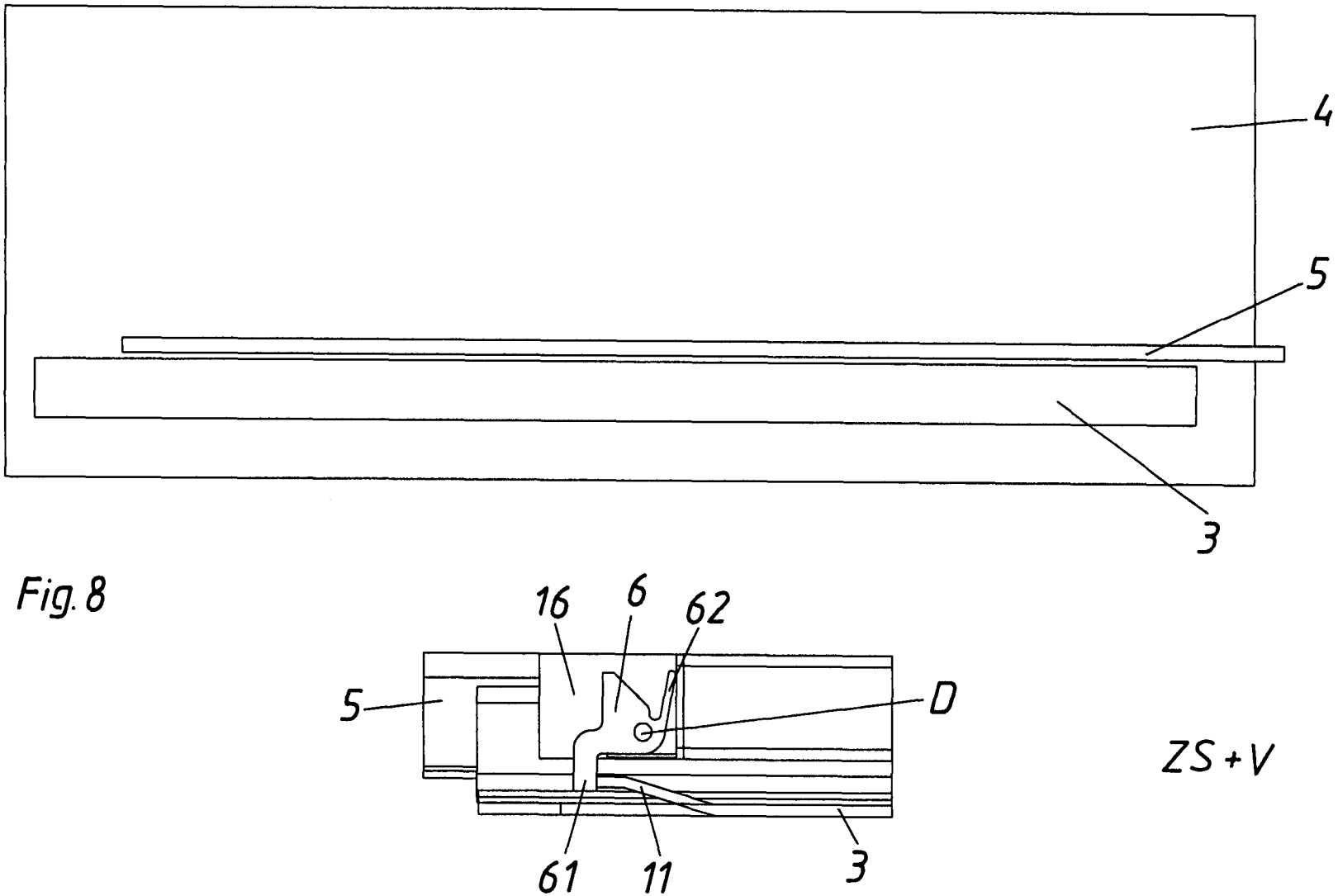
FIGS. 8 through 12 show diagrammatic views of the position of the rails relative to each other and the respective position of the locking element.

FIG. 8 diagrammatically shows at the top the position of the drawer rail 5 relative to the carcass rail 3 in the intermediate position ZS, wherein the locking element 6 is in the locking position V as shown in the lower view. In that case, the abutment extension 61 of the locking element 6 butts against the limiting extension 11 of the carcass rail 3.

Figure 9:
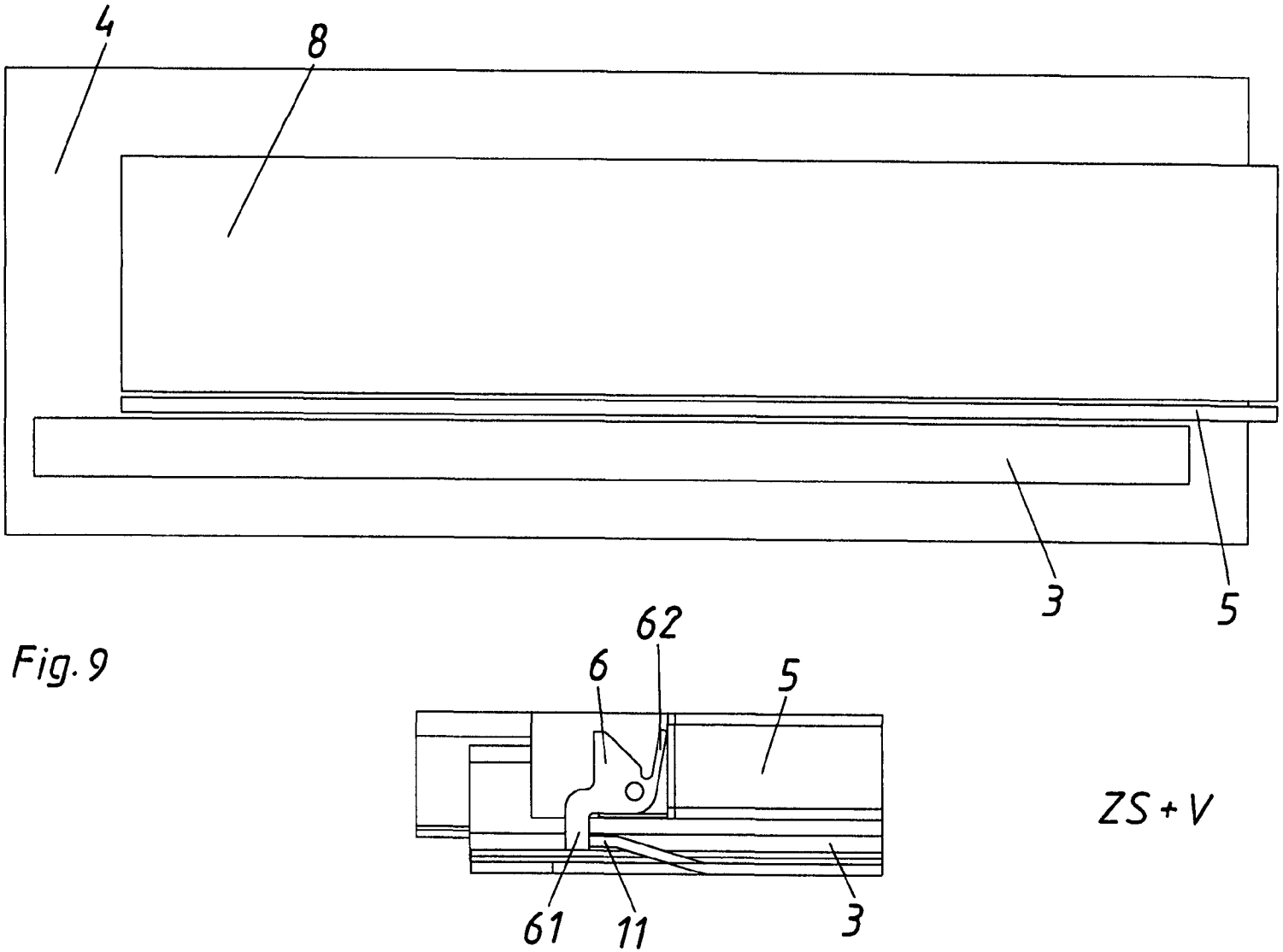

In FIG. 9 the drawer container 8 is then fixed to the drawer rail 5 which is in the intermediate position ZS.

Figure 10:
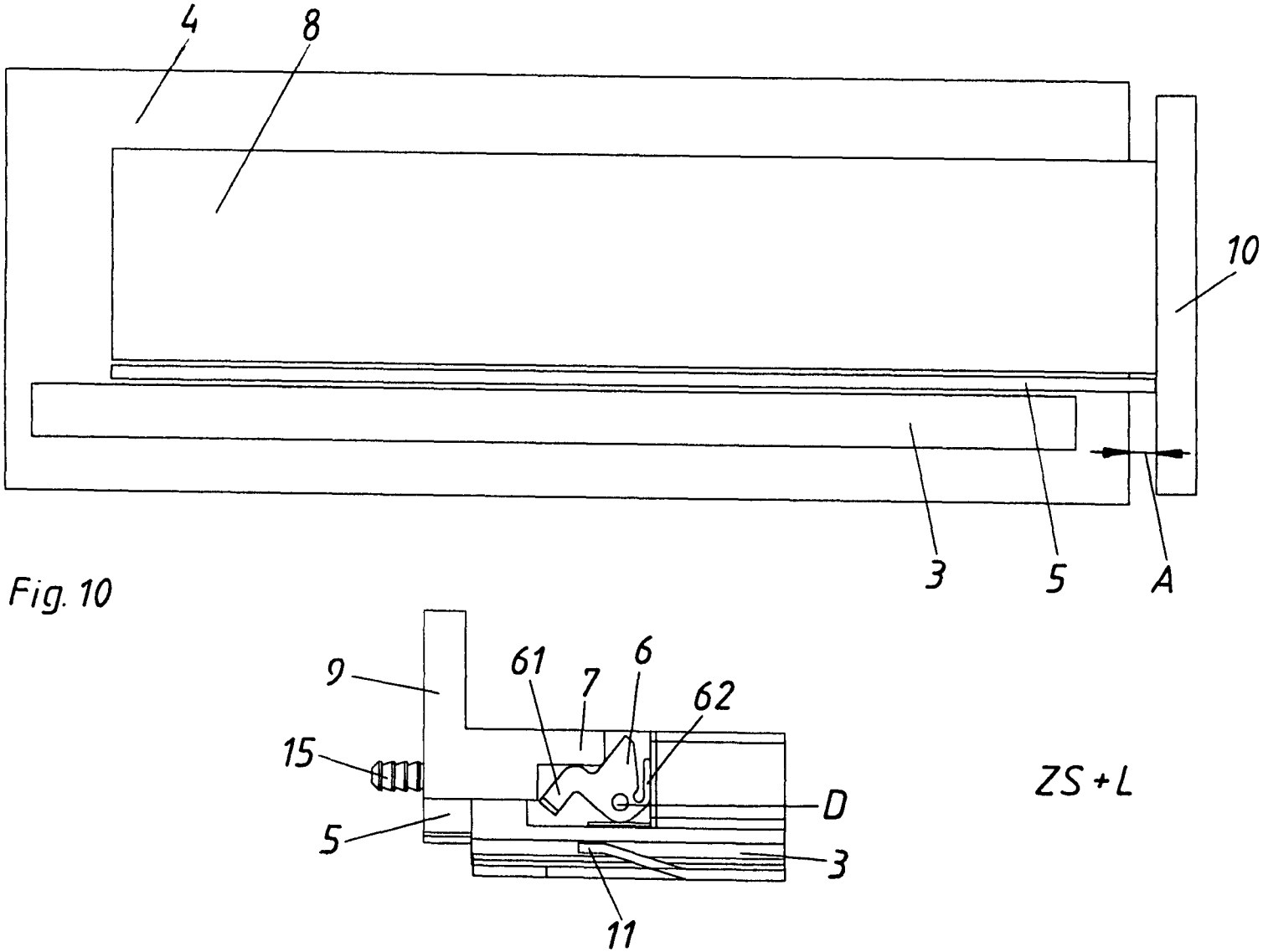

In FIG. 10, the front panel 10 is mounted to the drawer container 8, mounting being made possible by the spacing A in the intermediate position ZS between the end of the drawer container 8 and the furniture carcass 4. If the drawer rail 5 were already completely in the closed position SS then the front panel 10 would already butt against the furniture carcass 4 before reaching the drawer container 8. As can be seen in the view in the lower part of the Figure, connecting the front panel 10 or its connecting element 9 to the drawer container 8 causes movement of the release element 7 against the locking element 6 whereby that locking element is rotated about the pivot point D against the force of the spring 62 which bears against the drawer rail 5. As a result, the abutment extension 61 can no longer butt against the limiting extension 11, and the locking element 6 thus moves into the release position L in that intermediate position ZS whereby the entire drawer rail 5 (see FIG. 12) can be moved in the direction of the closed position SS.

Figure 11:
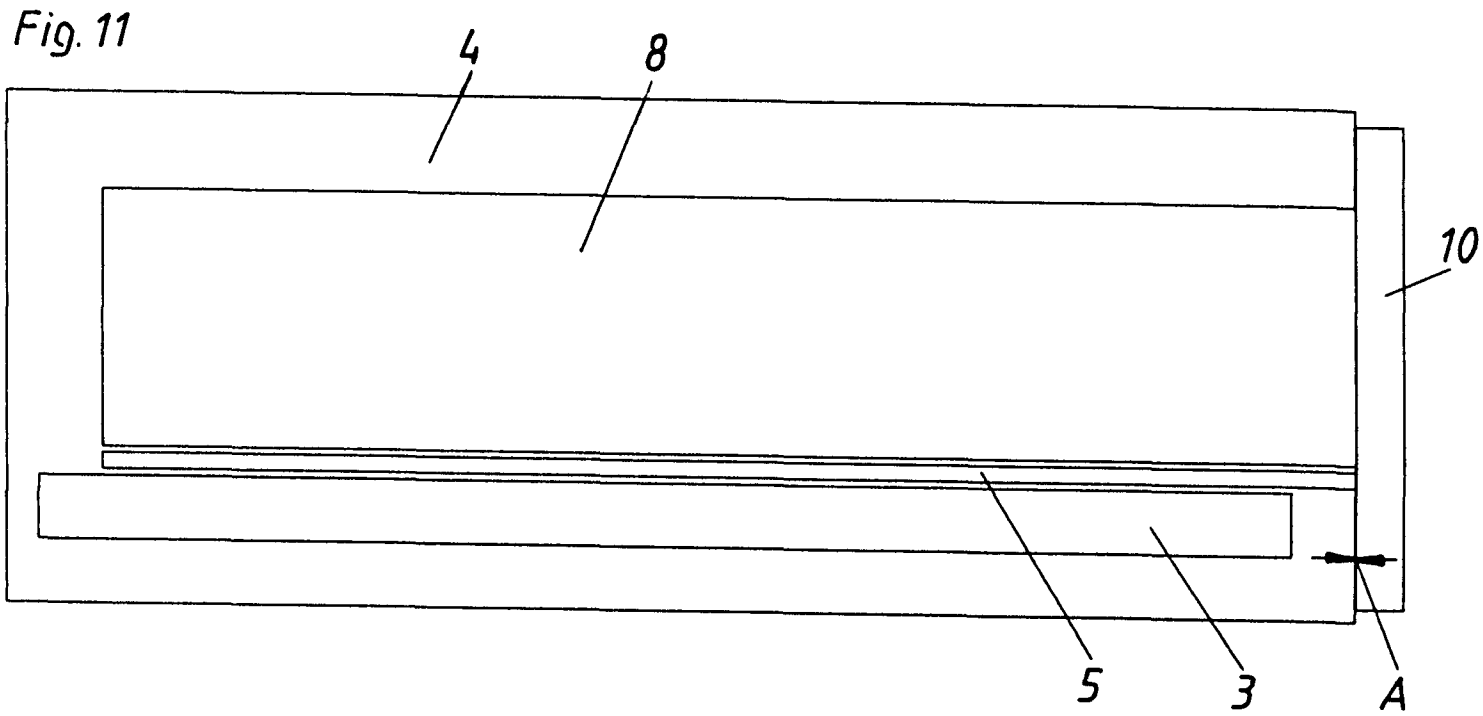

In FIG. 11, the closed position between the drawer rail 5 and the carcass rail 3 has admittedly not yet been reached, but nonetheless there is already an end position for the drawer 1 by virtue of the front panel 10 butting against the furniture carcass 4. In that case, the end of the drawer container 8 and the front side of the furniture carcass 4 are substantially in the same vertical plane (the spacing A is minimal).

Figure 12:
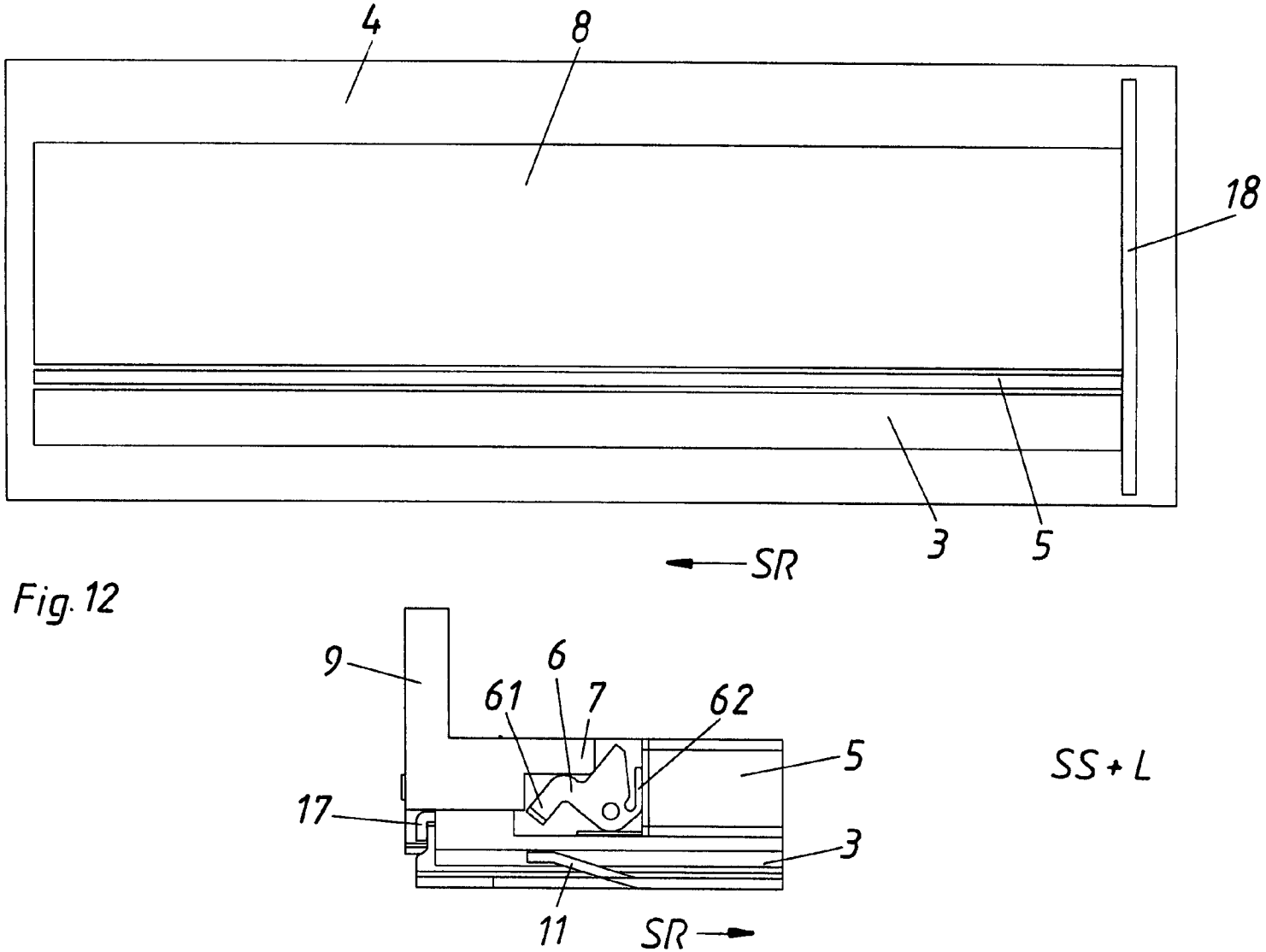

In comparison, FIG. 12 shows when it is not a front panel 10 of a front pull-out arrangement F, but an internal pull-out arrangement front panel 18 that is mounted to the drawer container 8 of the drawer 1. In this case, a release element 7 can be provided in the same manner on the front panel 18 of the internal pull-out arrangement I.

Figure 13:
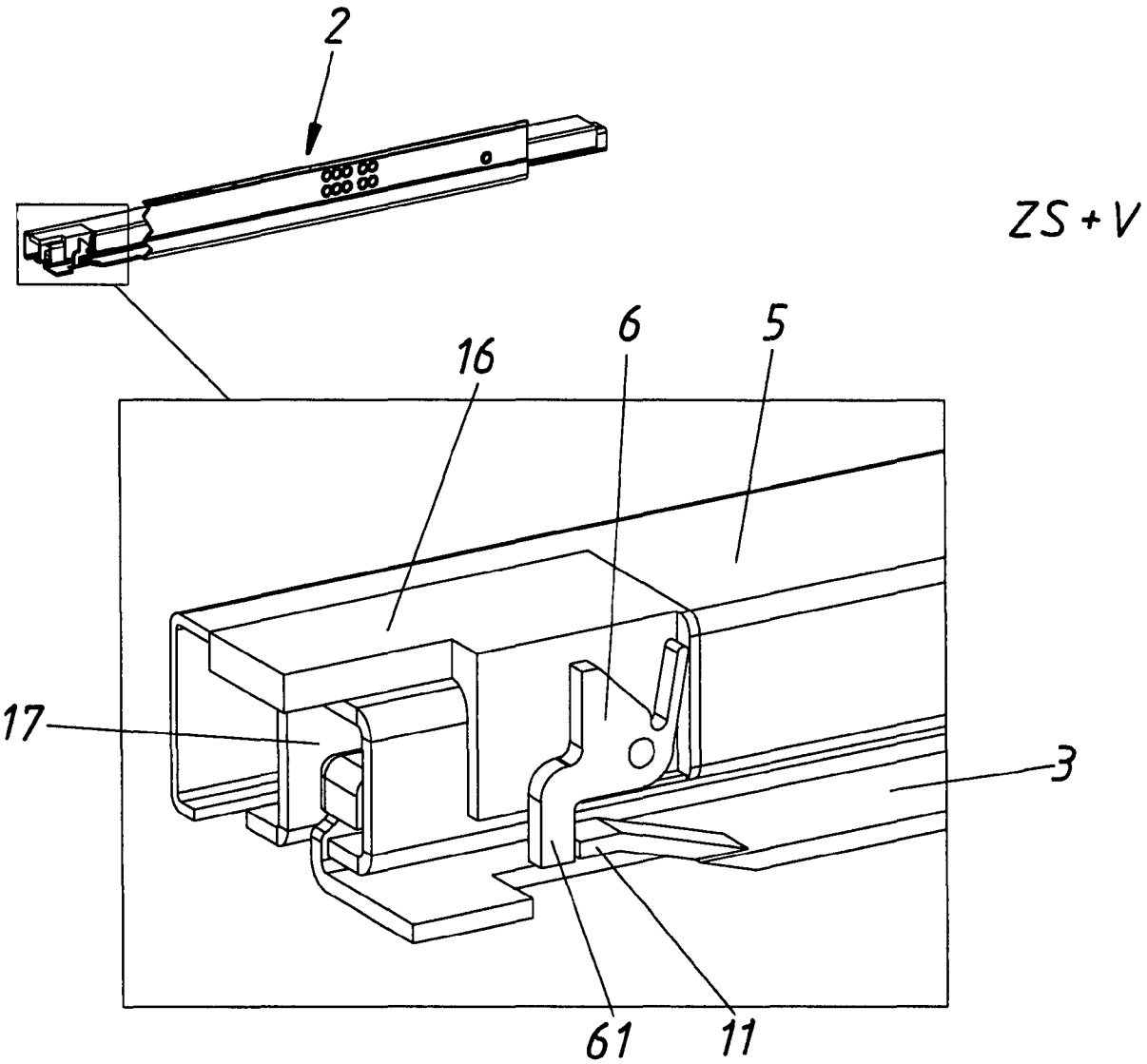
FIGS. 13 through 15 show 3D and side views of the extension guides in the region of the locking element.
Figure 14:
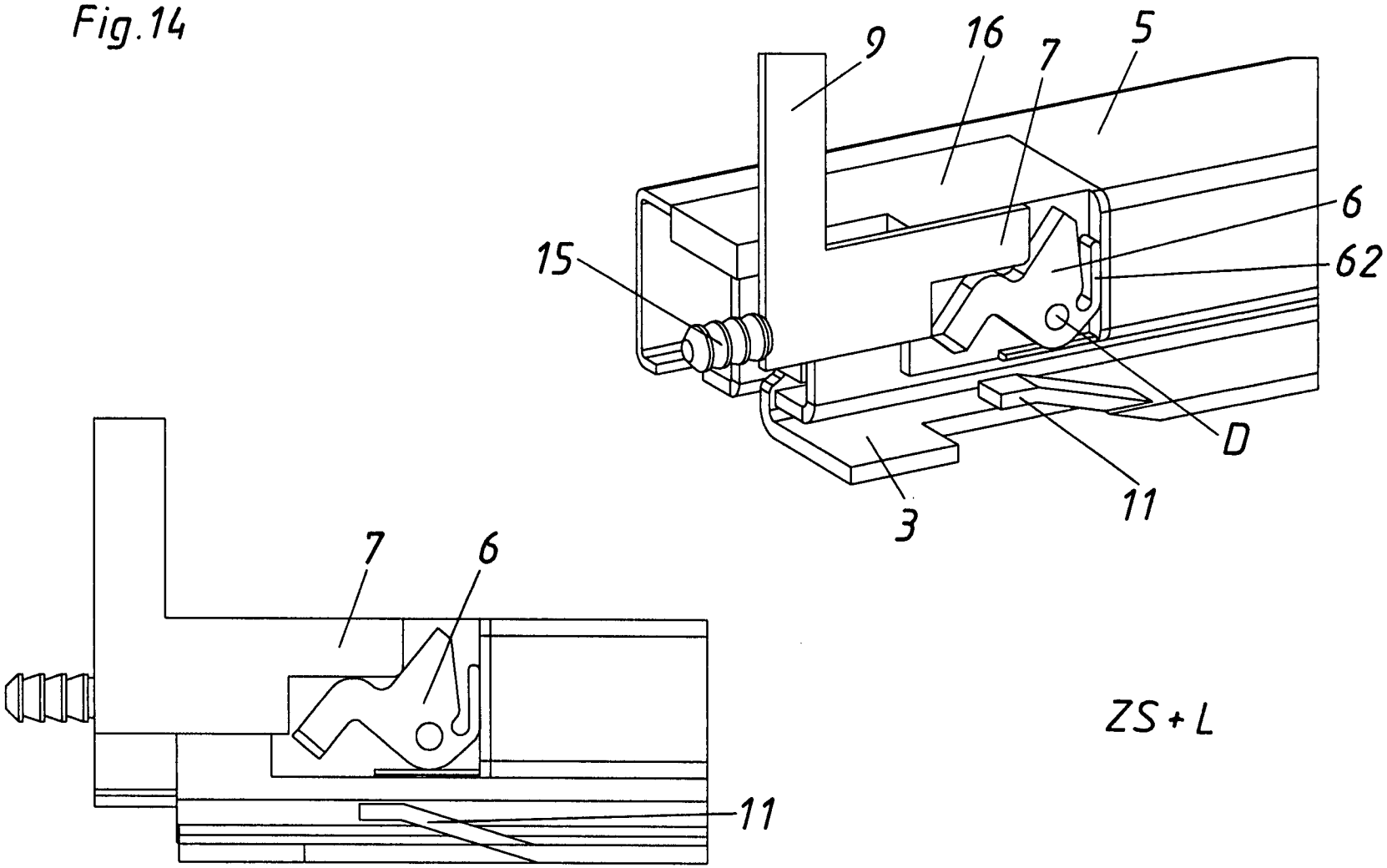
Figure 15:
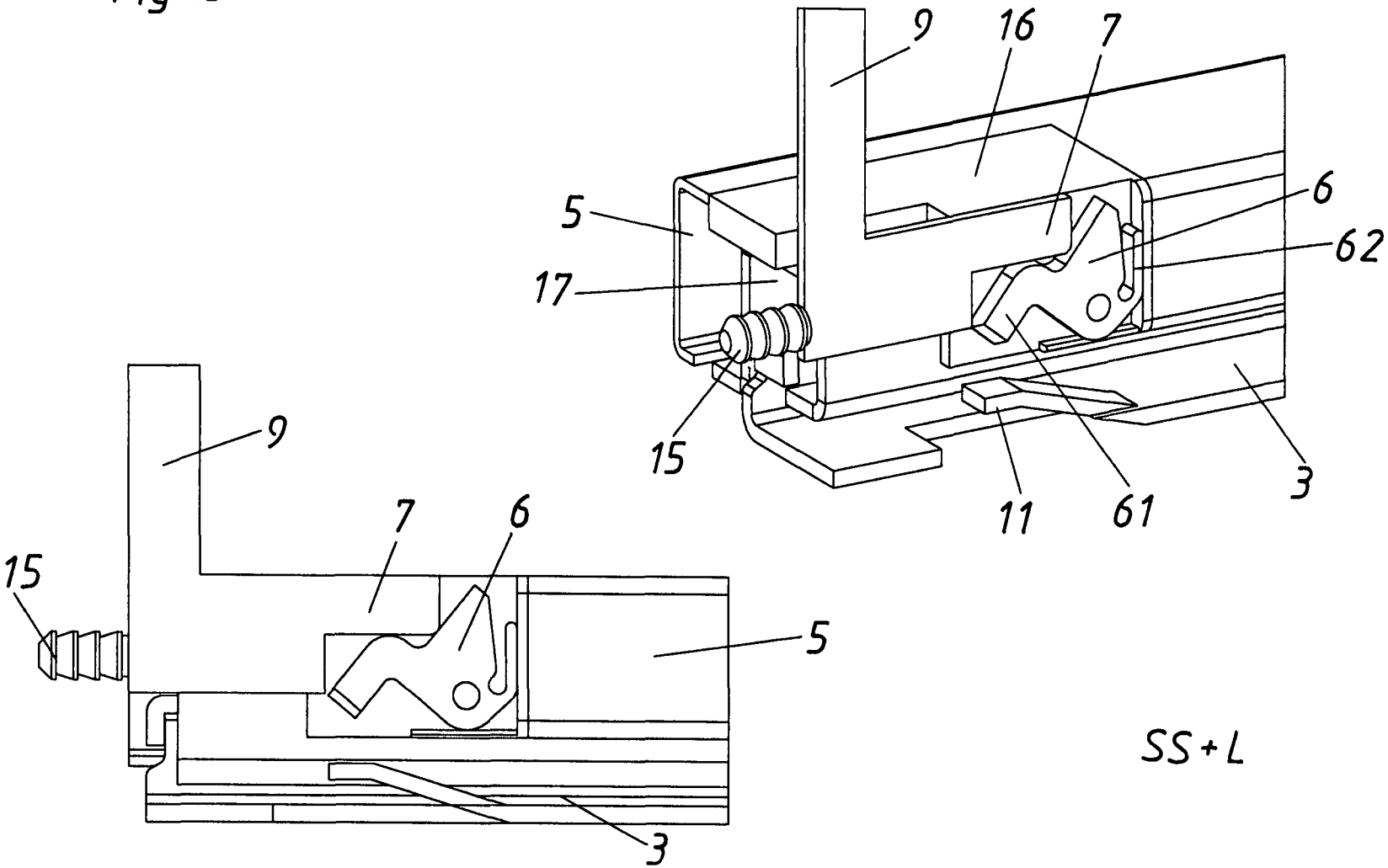

FIGS. 13 through 15 show once again in 3D views and side views the region of the extension guide 2 in which the locking element 6 butts against the limiting extension 11 (FIG. 13) or unlocking is effected by the release element 7 (FIG. 14) and the closed position SS is reached after unlocking (FIG. 15).

Figure 16:
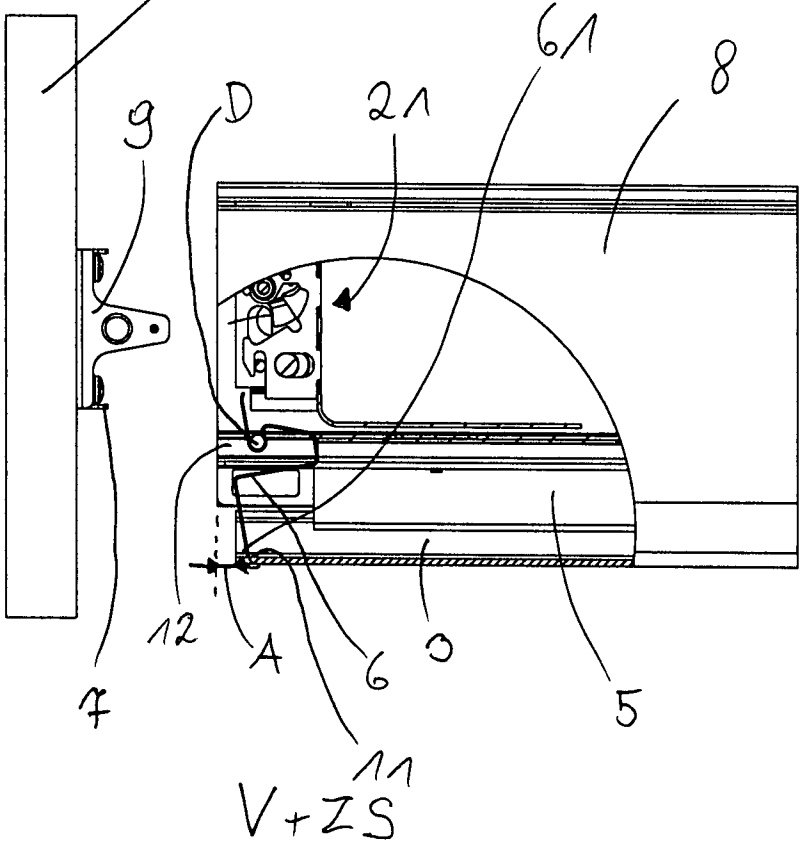
FIGS. 16 through 19 shows views of an alternative embodiment of the locking element.

FIG. 16 shows a side view of a drawer 1 comprising a drawer container 8 and a front panel 10. The drawer container 8 has a drawer frame structure 12 by way of which the drawer 1 is fixed to a drawer rail 5 of an extension guide 2. A locking element 6 is fixed to the drawer frame structure 12 by way of a pivot point D in pin form and in the locking position V butts with an end formed by the abutment extension 61 against the carcass rail 3 and its limiting extension 11. In that way, the drawer rail 5 together with the drawer 1 fixed thereto is removed from the closed position SS by the spacing A and a further movement of the drawer 1 in the closing direction SR is checked. The locking position V can thus be determined by the locking element 6.

Figure 17:
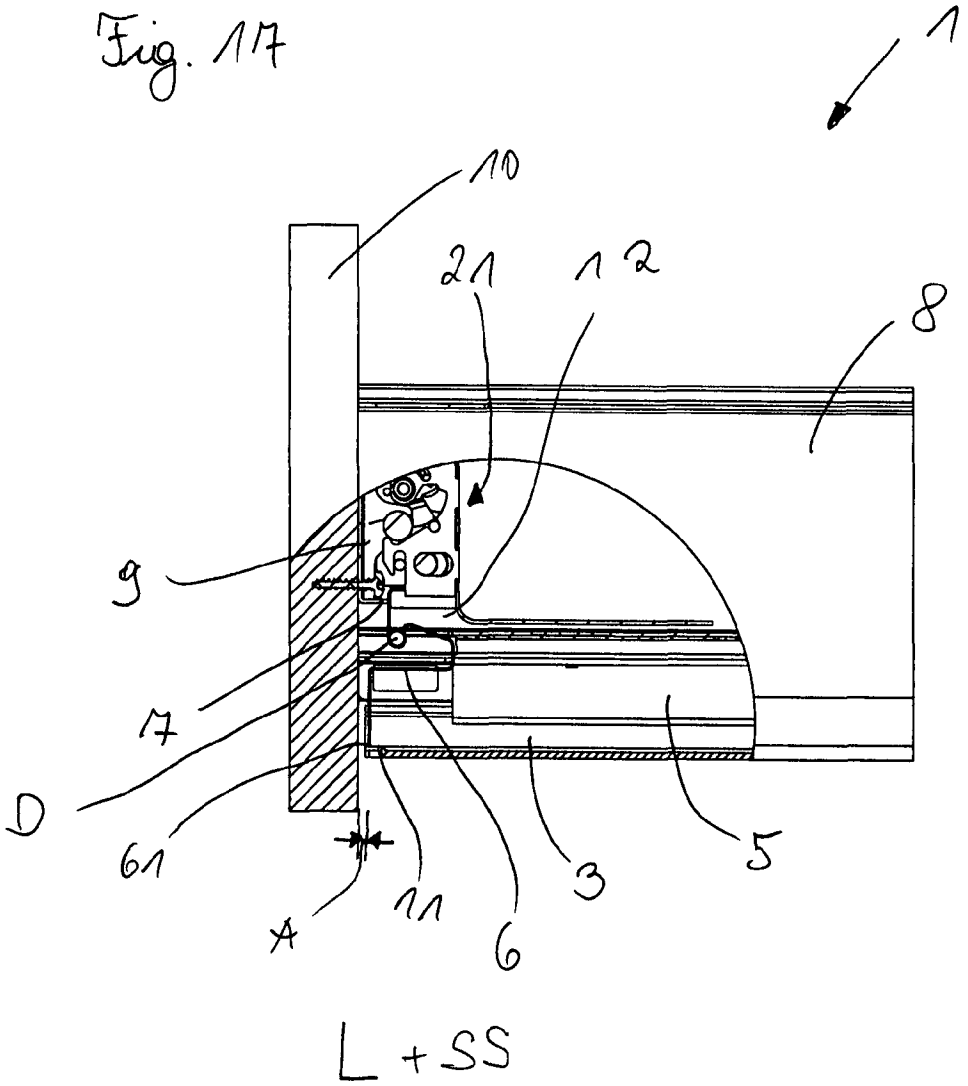

In comparison, FIG. 17 shows the release position L which is achieved by the front panel 10 together with the connecting element 9 fixed thereto (forms the front panel-side part of a front fitment 21) being mounted to the drawer frame structure 12 (more specifically to the container-side part 24 of the front fitment 21). In that case, the release element 7 formed by an extension of the connecting element 9 butts against an end of the locking element 6 so that the locking element 6 rotates about the pivot point D against the force of a spring 23 and thus the other end (abutment extension 61) of the locking element 6 is released from the limiting extension 11 of the carcass rail 3. In that way, the spacing A is minimized and the drawer rail 3 or the drawer 1 can move into the closed position SS.

Figure 18:
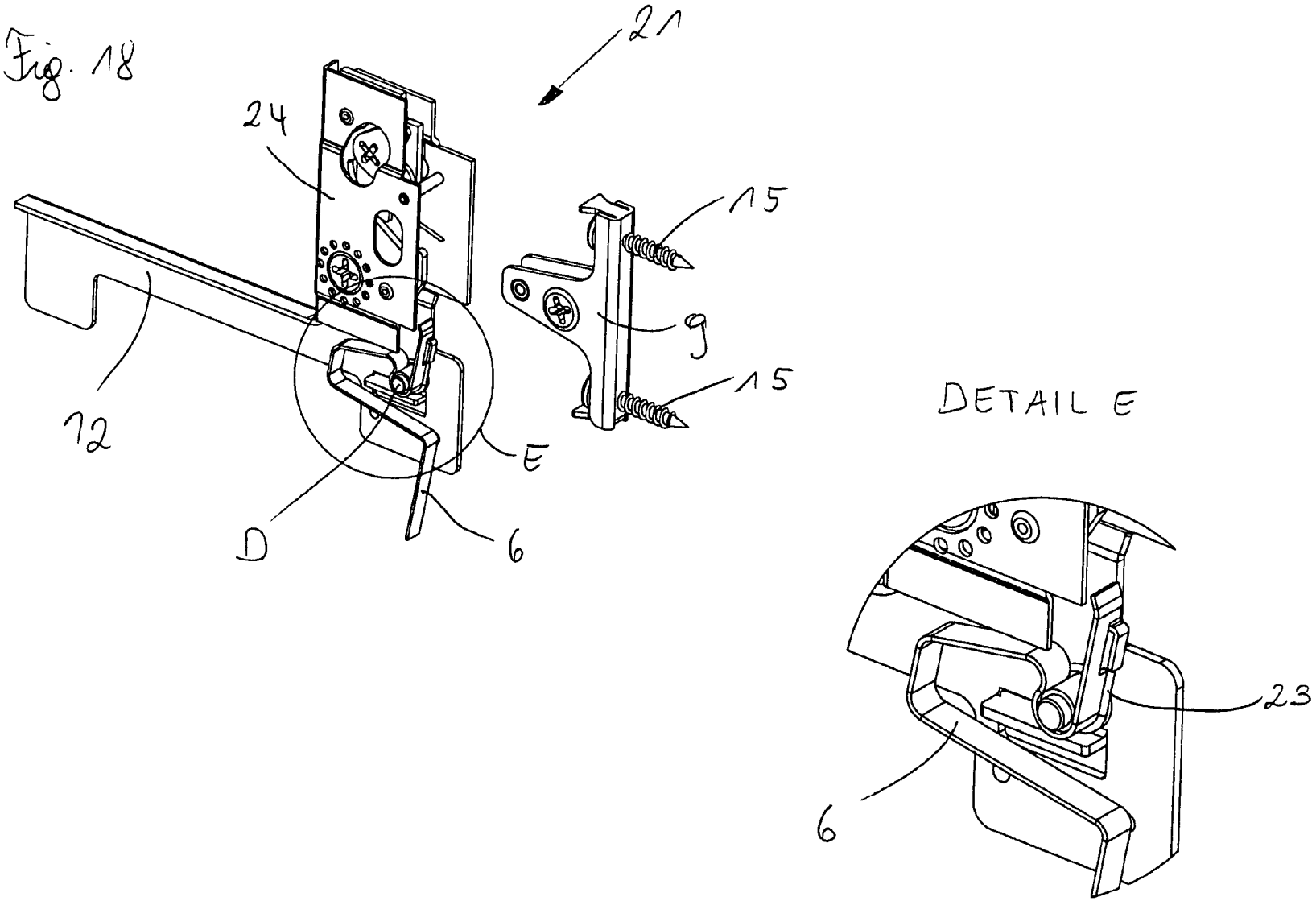
Figure 19:
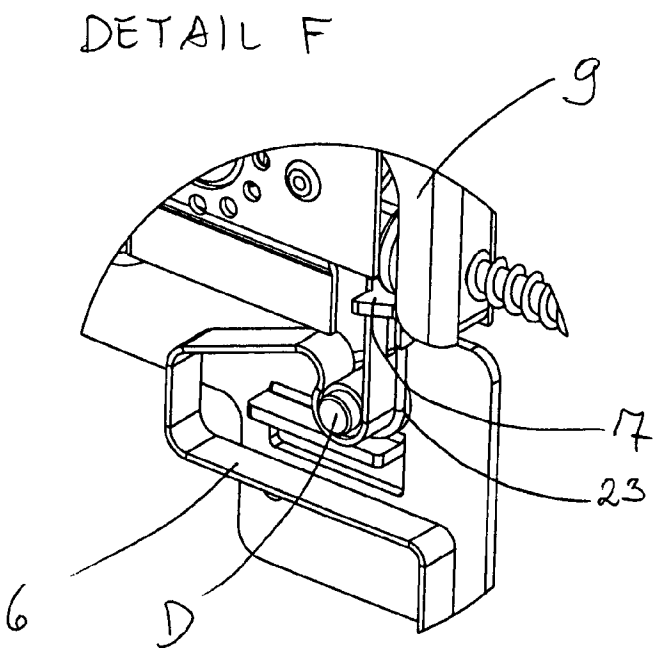
Figure 19:
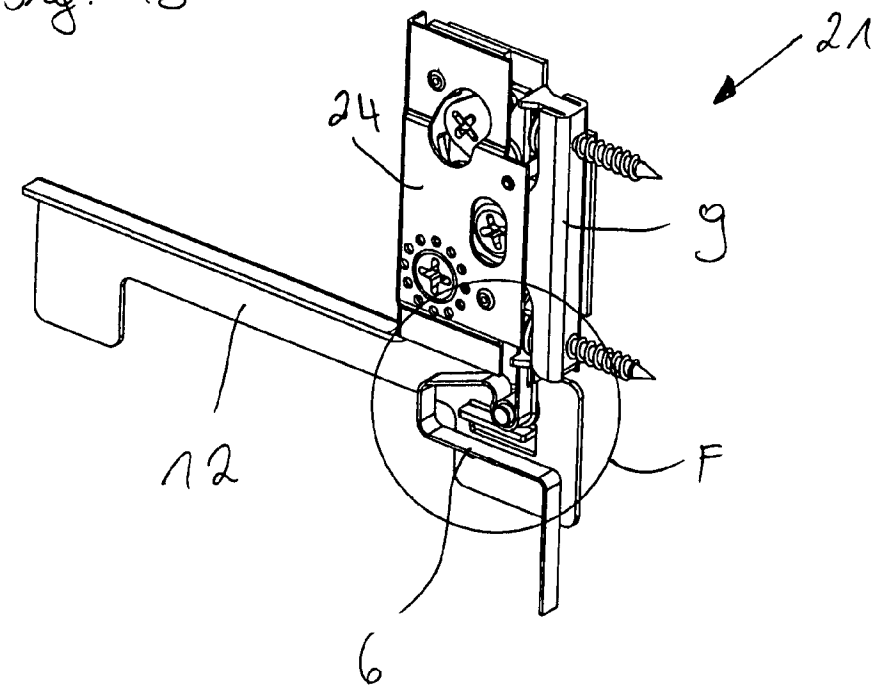

FIGS. 18 and 19 with the details E and F respectively show perspective views of only the front fitment 21 in the locking position V and the release position L respectively.

The invention claimed is:

1. An arrangement comprising:

a drawer having a drawer container and a front panel to be connected to said drawer container;

an extension guide for supporting said drawer, said extension guide including a carcass rail to be fixed to a furniture carcass and a drawer rail movable relative to said carcass rail between an open position and a closed position, said drawer configured to be fixed to said drawer rail;

a releasable locking element configured to:

stop a movement of said drawer rail in the closing direction relative to said carcass rail when said locking element is in a locking position and when said drawer rail is in an intermediate position before said drawer rail reaches a closed position; and allow the movement of said drawer rail in the closing direction relative to said carcass rail when said locking element is in a release position before said drawer rail reaches the closed position;

a release element configured to automatically unlock said locking element in response to either one of:

a drawer fixing motion in which said drawer is fixed to said drawer rail; and a front panel fixing motion in which said front panel is mounted to said drawer container already fixed to said drawer rail.

2. The arrangement as set forth in claim 1, wherein the closed position of said drawer rail is a completely closed position of said drawer, and said locking element is configured so that said drawer rail is lockable with respect to said carcass rail by said locking element at a position between 1 mm and 10 mm before the closed position.

3. The arrangement as set forth in claim 1, wherein said release element is arranged on said drawer.

4. The arrangement as set forth in claim 3, wherein said drawer container is configured to be connected to said front panel by a connecting element, said release element being arranged at one of said front panel or said connecting element.

5. The arrangement as set forth in claim 1, wherein said locking element is rotatably mounted to said drawer at a drawer frame structure of said drawer, and said locking element has an abutment extension for abutting against a limiting extension of said carcass rail in a locked position of said locking element to thereby stop a closing movement of said drawer rail relative to said carcass rail.

6. The arrangement as set forth in claim 1, wherein said locking element is arranged on said drawer rail so as to be movable between the locking position and the release position, and said locking element has an abutment extension for abutting against a limiting extension of said carcass rail in a locked position of said locking element to thereby stop a closing movement of said drawer rail relative to said carcass rail.

7. The arrangement as set forth in claim 6, wherein said locking element is configured to be moved by said release element from the locking position to the release position in response to the drawer fixing motion in which said drawer is fixed to said drawer rail.

8. The arrangement as set forth in claim 6, wherein said locking element is configured to be moved by said release element from the locking position to the release position in response to the front panel fixing motion in which said front panel is mounted to said drawer container by a connecting element.

9. The arrangement as set forth in claim 6, wherein said locking element is rotatably mounted to said drawer rail and has a leg spring bearing against said drawer rail, said release element being configured to rotate said locking element together with said abutment extension into the release position against a spring force of said leg spring during said automatic unlocking.

10. The arrangement as set forth in claim 6, wherein said locking element having said abutment extension and a spring is formed as a one-piece, injection-molded plastic part.

11. An article of furniture comprising:

a furniture carcass; and said arrangement of claim 1 disposed on said furniture carcass.

* * * * *